US009362652B2

(12) United States Patent
Kuroda

(10) Patent No.: US 9,362,652 B2
(45) Date of Patent: Jun. 7, 2016

(54) CONNECTOR WITH AT LEAST ONE DETECTOR

(71) Applicant: Sumitomo Wiring Systems, Ltd., Yokkaichi, Mie (JP)

(72) Inventor: Shinya Kuroda, Mie (JP)

(73) Assignee: Sumitomo Wiring Systems, Ltd. (JP)

( * ) Notice: Subject to any disclaimer, the term of this patent is extended or adjusted under 35 U.S.C. 154(b) by 0 days.

(21) Appl. No.: 14/616,979

(22) Filed: Feb. 9, 2015

(65) Prior Publication Data

US 2015/0249300 A1 Sep. 3, 2015

(30) Foreign Application Priority Data

Feb. 28, 2014 (JP) ..... 2014-037988

(51) Int. Cl.

*H01R 13/44* (2006.01)
*H01R 13/627* (2006.01)
*H01R 13/639* (2006.01)
*H01R 13/642* (2006.01)

(52) U.S. Cl.

CPC ..... *H01R 13/44* (2013.01); *H01R 13/6272* (2013.01); *H01R 13/639* (2013.01); *H01R 13/642* (2013.01)

(58) Field of Classification Search

CPC ..... H01R 13/4362; H01R 13/4365; H01R 13/4368; H01R 13/44; H01R 13/642; H01R 13/6272; H01R 13/6273

USPC ..... 439/489, 352, 353, 354, 357

See application file for complete search history.

(56) References Cited

U.S. PATENT DOCUMENTS

| | | | | |
|---|---|---|---|---|
| 5,120,255 | A * | 6/1992 | Kouda | H01R 13/641 439/489 |
| 6,468,105 | B2 * | 10/2002 | Noguchi | H01R 13/4367 439/352 |
| 7,252,530 | B2 * | 8/2007 | Shamoto | H01R 13/641 439/352 |
| 7,722,385 | B2 | 5/2010 | Nakamura | |
| 2002/0064997 | A1 | 5/2002 | Noguchi et al. | |
| 2007/0178739 | A1 | 8/2007 | Kuwayama | |
| 2009/0035980 | A1 * | 2/2009 | Nakamura | H01R 13/641 439/352 |
| 2009/0170362 | A1 | 7/2009 | Nakamura | |
| 2011/0021060 | A1 | 1/2011 | Urano et al. | |

FOREIGN PATENT DOCUMENTS

JP 2009 158263 7/2009

OTHER PUBLICATIONS

European Patent Appl. No. 15000551.0—extended European Search Report issued Jun. 25, 2015.

* cited by examiner

*Primary Examiner* — Abdullah Riyami
*Assistant Examiner* — Harshad Patel
(74) *Attorney, Agent, or Firm* — Gerald E. Hespos; Michael J. Porco; Matthew T. Hespos

(57) ABSTRACT

A detector (60) is supported on a lock arm (15) of the housing (10) movably between a standby position and a detection position. The detector (60) includes restricting portions (69) and the housing (10) include escaping portions (28). The escaping portions (28) extend in a direction intersecting a connecting direction, and the restricting portions (69) are inserted therein when the detector (60) is inclined in a connecting process and brought into contact with a wall surface facing in a moving direction of the detector (60) to prevent the detector (60) from reaching the detection position while being kept in an inclined state when the detector (60) moves from the standby position toward the detection position.

11 Claims, 10 Drawing Sheets

CONNECTOR WITH AT LEAST ONE DETECTOR

BACKGROUND

1. Field of the Invention

The present invention relates to a connector.

2. Description of the Related Art

U.S. Pat. No. 7,722,385 discloses a connector with a housing that has a deflectable lock arm. The housing is connectable to a mating housing and has a detecting member movable in a connecting direction from a standby position to a detection position while supported on the lock arm. The lock arm interferes with a lock projection on the mating housing while connecting the housing to the mating housing and deflects. As a result, the detecting member inclines with respect to the connecting direction. Further, the detecting member is kept at the standby position and is prevented from moving to the detection position in the process of connecting the housings. The lock arm displaces in a return direction when the housing is connected properly to the mating housing and engages the lock projection to hold the housings in a connected state. Further, the detecting member is released from the standby position and can move to the detection position, thereby indicating that the housings have been connected properly.

The detecting member that has moved toward the detection position after the housings are connected properly may remain inclined and may interfere with a facing wall of the housing or the like and come off, which may impair in connection detection reliability.

The invention was completed based on the above situation and aims to enhance reliability in connection detection.

SUMMARY OF THE INVENTION

The invention relates to a connector with a housing that is connectable to a mating housing. The housing has a deflectable lock arm and a detector is supported on the lock arm. The detector is movable in a connecting direction from a standby position to a detection position. The lock arm is deflected and deformed in the process of connecting the housing to the mating housing and is kept at the standby position in a state inclined with respect to the connecting direction. The lock arm is displaced in a return direction to hold the mating housing in a connected state and the detector is allowed to move to the detection position as the housing is connected properly to the mating housing. The detector includes a restricting portion, and the housing includes an escaping portion extending in a direction intersecting the connecting direction. The escaping portion is configured to receive the restricting portion when the detector is inclined in a connecting process and is configured to prevent the detector from reaching the detection position in an inclined state by causing the restricting portion to contact a wall surface that faces in a moving direction of the detector when the detector moves from the standby position to the detection position.

The housing may include at least one guide connected to the at least one escaping portion and extending substantially in the connecting direction. The guide is configured so that the restricting portion is inserted therein to guide a movement of the detector in the process of moving the detector from the standby position to the detection position. The detector can smoothly reach the detection position from the standby position by the insertion of the restricting portion into the guide.

An opening edge of the guide and/or of the escaping portion may be curved and chamfered.

At least one wall of the housing may be present at an intermediate position of a virtual movement path when the detector inclined in the connecting process and is assumed to move to the detection position while being kept in the inclined state. In the prior art, the inclined detector may contact with the wall of the housing on the way to the detection position and may not reach the detection position. However, in the case of the invention, a movement of the detector in the inclined state to the detection position is hindered by the escaping portion, wherefore the inclined state of the detecting member is canceled and the detector is brought reliably to the detection position.

The escaping portion may have at least one inclined guide surface that is configured to cancel the inclined state of the detector and to guide the detector to a proper posture by causing the detector moving toward the detection position to slide thereon. Thus, the detector will reach the detection position while being corrected to the proper posture.

The detector may include an upper plate, two side plates extending substantially in the connecting direction along the upper plate, a rear portion extending substantially in the width direction and a resilient lock extending substantially forward from the rear portion.

A front end of the upper plate may be retracted back from the front ends of the side plates and the front end of the resilient lock.

A front end of the restricting portion may be inclined back toward a projecting tip and a rear end of the restricting portion may be arranged substantially along the width direction.

When the detector is at the standby position, the retaining receiving portion is arranged to contact the retaining portion to prevent a backward movement of the detector and the locking projection is arranged to contact a rear end of a lock of the housing to prevent a forward movement of the detector.

When the detector is at the detection position, the locking projection is arranged to contact the lock to prevent a backward movement of the detector and the upper plate is arranged to contact a stopper wall of the housing to prevent a forward movement of the detector At least one confirmation window may be provided in the detector and the housing to allow confirming the position of the detector through the confirmation window.

According to the above, if the detector is kept inclined with respect to the connecting direction when the detector moves toward the detection position after the two housings are properly connected, the restricting portion contacts the wall surface of the escaping portion. Thus, a movement of the detector kept in the inclined state to the detection position is prevented. Therefore, reliability in connection detection by the detecting member can be enhanced.

These and other objects, features and advantages of the invention will become more apparent upon reading of following detailed description of preferred embodiments and accompanying drawings.

DETAILED DESCRIPTION

A connector in accordance with an embodiment of the invention includes a housing 10 and a detector 60 to be assembled with the housing 10 in FIGS. 1-10. The housing 10 is connectable to a mating housing 90. Note that, in the following description, ends facing each other when the connection of the two housings 10, 90 is started are referred to as front ends concerning a front-back direction, and a vertical direction is based on FIGS. 2 to 7 and 9. In the following description, the front-back direction is synonymous with a connecting direction CD.

Figure 2:
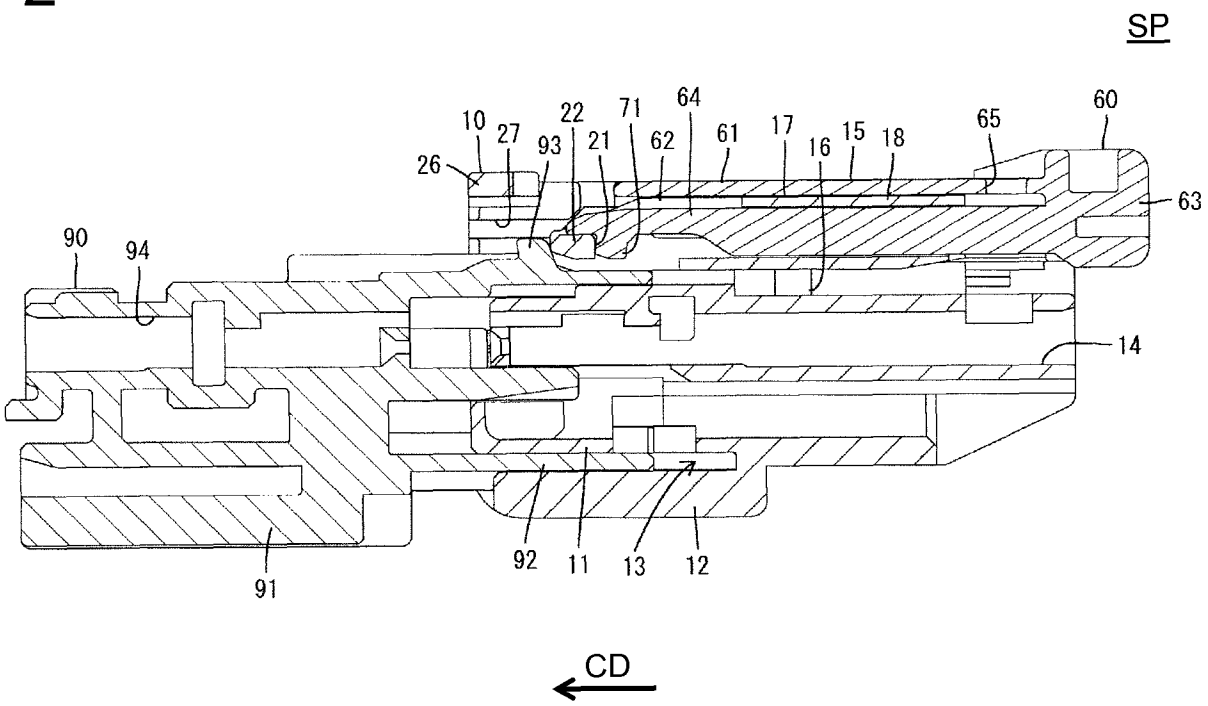
FIG. 2 is a section showing a state where the housing is fit lightly to a mating housing.

The mating housing 90 is made of synthetic resin and includes, as shown in FIG. 2, a block-like terminal accommodating portion 91 and a tubular receptacle 92 projecting forward from the front end of the terminal accommodating portion 91. A lock 93 projects on the upper surface of the upper wall of the receptacle 92.

Figure 4:
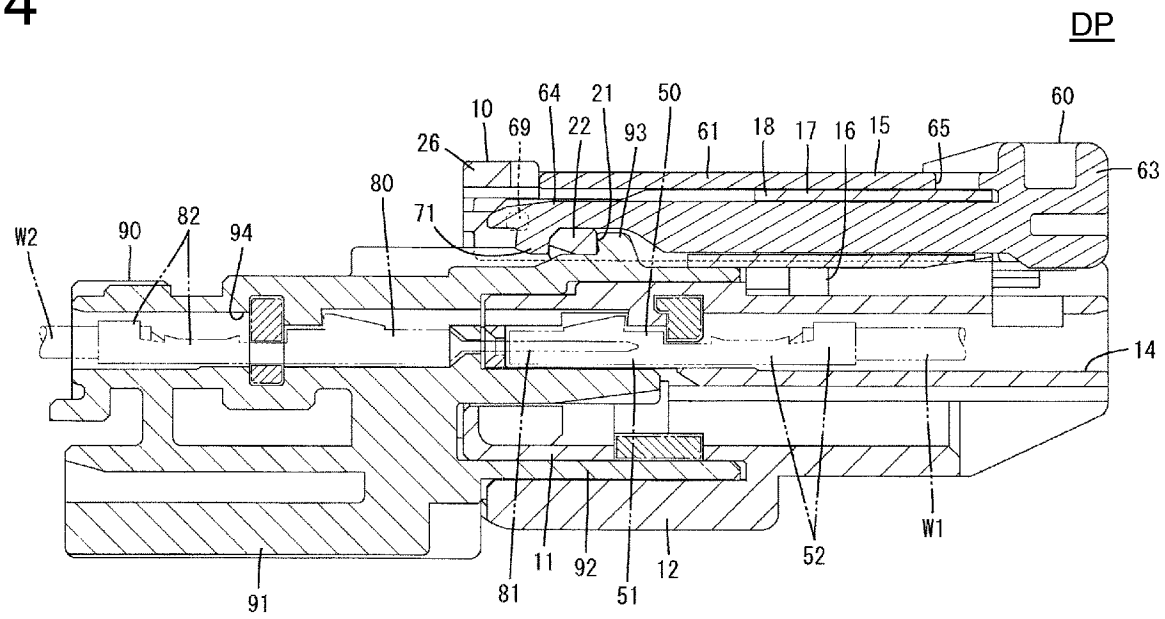
FIG. 4 is a section showing a state reached by moving the detector to a detection position.

Mating cavities 94 extend in the front-back direction in the terminal accommodating portion 91. The mating cavities 94 are arranged side by side in a width direction and mating terminal fittings 80 are inserted therein from behind, as shown in FIG. 4. The mating terminal fitting 80 is made of electrically conductive metal and includes a male tab 81 projecting forward and a barrel-shaped mating crimping portion 82 located behind the male tab 81. The mating crimping portion 82 is connected by crimping to an end part of a wire W2. Further, the male tab 81 is arranged to project into the receptacle 92.

Figure 9:
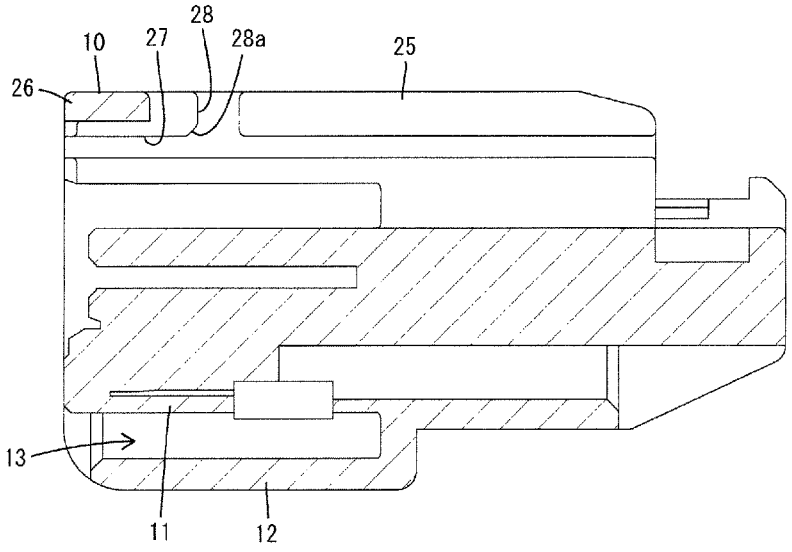
FIG. 9 is a section of the housing.

The housing 10 is made of synthetic resin and includes a block-like housing main body 11 and a fitting tube 12 surrounding the housing main body 11, as shown in FIG. 9. A space between the housing main body 11 and the fitting tube 12 is open forward as a connection space 13. As shown in FIG. 2, the receptacle 92 of the mating housing 90 is fittable into the connection space 13 of the housing 10.

Figure 7:
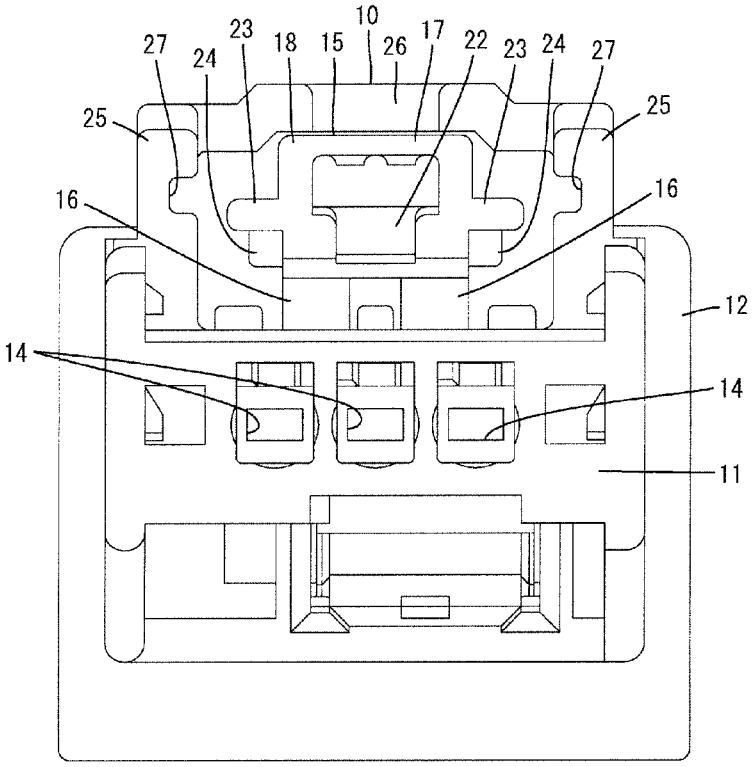
FIG. 7 is a rear view of the housing.

Cavities 14 extend through the housing main body 11 in the front-back direction at positions corresponding to the respective mating cavities 94. The cavities 14 are arranged side by side in the width direction, as shown in FIG. 7, and terminal fittings 50 are inserted therein from behind, as shown in FIG. 4. The mating terminal fitting 50 is made of electrically conductive metal and, as shown in FIG. 4, includes a tubular terminal main body 51 and a barrel-shaped crimping portion 52 located behind the terminal main body 51. The crimping portion 52 is crimped and connected to an end part of a wire W1. Further, the male tab 81 of the mating terminal fitting 80 is inserted into the terminal main body 51 when the two housings 10, 90 are connected. The male tab 81 is inserted into the terminal main body 51 contacts an unillustrated contact portion in the terminal main body 51 to connect the two terminal fittings 50, 80 electrically.

A lock arm 15 is provided on the upper surface of the housing main body 11. The lock arm 15 includes two legs 16 standing from the upper surface of the housing main body 11, as shown in FIG. 7, and an arm main body 17 extends in both forward and backward directions from the upper ends of both legs 16, as shown in FIG. 2. The arm main body 17 is resiliently displaceable in a seesaw-like pivotal displacement with both legs 16 as supports.

Figure 8:
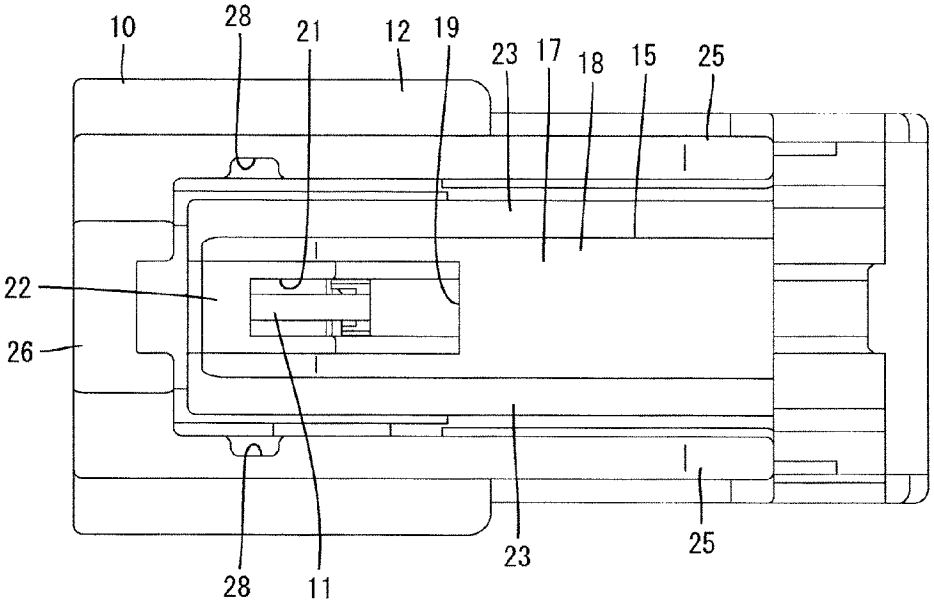
FIG. 8 is a plan view of the housing.

As shown in FIGS. 2 and 8, the arm main body 17 includes an inserting tube 18 in the form of a rectangular tube penetrating in the front-back direction. The detector 60 is mounted into the inserting tube 18 from behind. As shown in FIG. 8, a substantially front half of the upper wall of the inserting tube portion 18 is open as a cut-like opening 19. Further, a lock hole 21 penetrates through the lower wall of the inserting tube 18 below the opening 19. In a state where the detector 60 is not assembled with the lock arm 15, the upper surface of the housing main body 11 can be confirmed visually through the opening 19 and the lock hole 21. A lock 22 extends in the width direction before the lock hole 21 on a front end part of the inserting tube 18.

Rails 23 extend in the front-back direction on opposite side edges of the inserting tube 18, as shown in FIGS. 7 and 8. Furthermore, two retaining portions 24 are coupled unitarily to lower sides of both rails 23 and project substantially in the centers of the opposite side edges of the inserting tube 18 in the front-back direction.

As shown in FIG. 7, two side walls 25 stand substantially vertically at opposite sides of the lock arm 15 atop the fitting tube 12. The lock arm 15 is protected by being covered laterally by the side walls 25. Further, a stopper wall 26 (see FIG. 8) bridges between the upper edges of the front ends of both side walls 25 is higher above the fitting tube 12.

Figure 6:
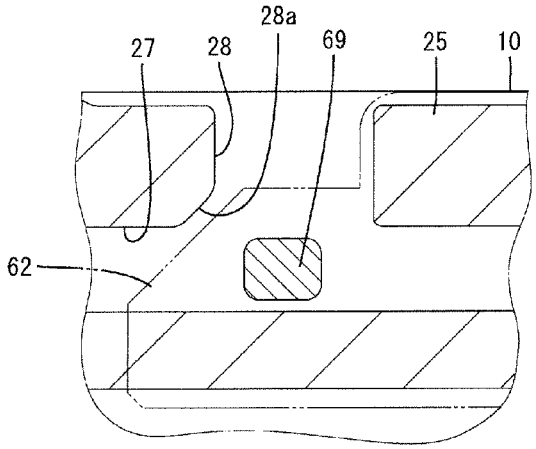
FIG. 6 is an enlarged view of an essential part of FIG. 5.

As shown in FIGS. 7 and 9, guides 27 in the form of recessed grooves are provided on the opposed inner surfaces of the side walls 25 and extend over the entire length in the front-back direction. Later-described restricting portions 69 of the detector 60 are fit and inserted into the guides 27. Further, as shown in FIGS. 6 and 9, two escaping portions 28, in the form of recessed grooves, are provided on the inner surfaces of the side walls 25 and communicate with intermediate parts near the front ends of the guides 27 in the front-back direction. The escaping portions 28 extend from coupled positions in an upward direction intersecting the front-back direction and open on the upper ends of the side walls 25. The restricting portions 69 moving from the both guides 27 are loosely insertable into the escaping portions 28. Note that opening edges of the guides 27 and the escaping portions 28 on the inner surfaces of the side walls 25 are curved and chamfered over the entireties.

Figure 10:
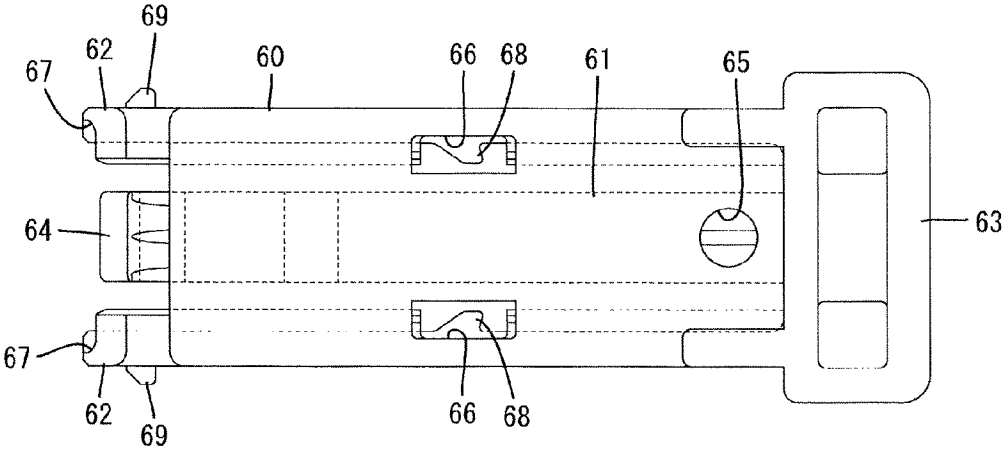
FIG. 10 is a plan view of the detecting member.

The detector 60 is made of synthetic resin and has a rectangular shape that is long in the front-back direction in a plan view, as shown in FIG. 10. The detector 60 is movable to a standby position SP (see FIGS. 1 to 3 and 5) and a detection position DP (see FIG. 4) before the standby position SP in a state supported on the lock arm 15.

The detector 60 includes a rectangular upper plate 61, as shown in FIGS. 2 and 10. Two side plates 62 project substantially perpendicularly down from opposite side edges of the upper plate 61 and extend in the front-back direction along the opposite side edges of the upper plate 61. A rear portion 63 extends in the width direction and is unitary with the rear ends of both side plates 62 and the upper plate 61. A long, narrow resilient locking portion 64 extends forward from a widthwise center of a lower part of the front surface of the rear portion 63.

As shown in FIGS. 2 and 10, the rear portion 63 bulges farther toward opposite widthwise sides and upper side than the upper plate 61 and the detector 60 can be moved by gripping the rear portion 63. The upper plate 61 is flat and a circular confirmation window 65 is open on a rear end part, as shown in FIG. 10. Further, two mold removal holes 66 are open in the width direction in a substantially central part of the upper plate 61 in the front-back direction by the passage of a mold when retaining receiving portions 68 to be described later are molded. Note that the front end of the upper plate 61 is arranged to be retracted more backward with respect to the front ends of the side plates 62 and the front end of the resilient locking portion 64.

As shown in FIG. 10, two rail receiving grooves 67 extend in the front-back direction on the inner surfaces of the side plate portions 62 and are open on the front ends. Further, two retaining receiving portions 68 project below the rail receiving portions 67 in substantially central parts of the inner surfaces of the side plates 62 in the front-back direction.

As shown in FIG. 10, two restricting portions 69 project on front end parts of outer side edges of the side plates 62. The restricting portions 69 are arranged before the front end of the upper plate 61. The front end of each restricting portion 69 is inclined back toward a projecting tip and the rear end thereof is arranged along the width direction. As shown in FIG. 6, a vertical dimension of the restricting portion 69 is slightly smaller than a width of the guide 27 and a dimension thereof in the front-back direction is sufficiently smaller than a groove width of the escaping portion 28 in the front-back direction.

Figure 3:
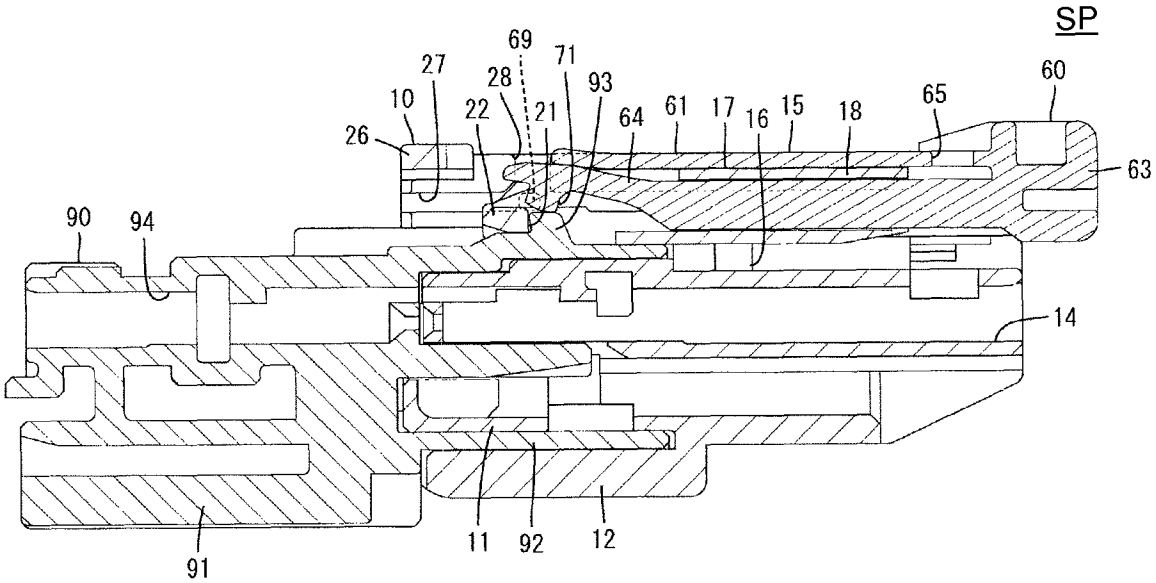
FIG. 3 is a section showing a state where the housing is properly connected to the mating housing and the detector at the standby position is released from a locked state.

As shown in FIGS. 3 and 4, the resilient locking portion 64 is deflectable and deformable substantially in the vertical direction or in/out toward and away from the housing main body 11. In this case, the resilient locking portion 64 displaced up and contacts the upper plate 61, thereby preventing excessive deformation of the resilient locking portion 64. Further, a claw-like lock 71 projects down on the front end of the resilient locking portion 64.

Figure 1:
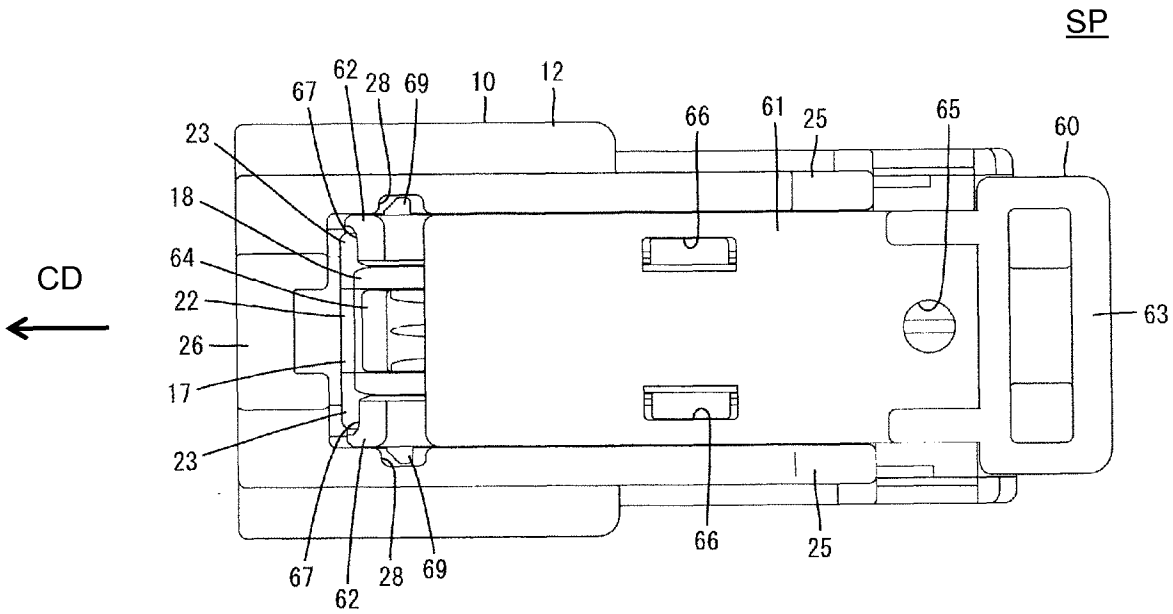
FIG. 1 is a plan view showing a state where a detector is held at a standby position in a housing in a connector of an embodiment of the invention.

When the detector 60 is assembled with the lock arm 15, the upper plate 61 is arranged to cover the arm main body 17 from above, the resilient locking portion 64 is inserted into the inserting tube 18 of the arm main body 17, the side plates 62 are arranged at opposite lateral sides of the inserting tube 18 and the rails 23 are fit into the rail receiving portions 6, 7 as shown in FIGS. 1 and 2.

As shown in FIG. 2, the upper wall of the inserting tube 18 is sandwiched between the upper plate 61 and the resilient locking portion 64 of the detector 60. When the detector 60 is at the standby position SP, the retaining receiving portions 68 are arranged to contact the front ends of the retaining portions 24 to prevent a backward movement of the detector 60 and the locking projection 71 is arranged to contact the rear end of the lock 22 to prevent a forward movement of the detector 60 and to hold the detector 60 is held at the standby position SP.

Further, as shown in FIG. 4, when the detector 60 is at the detection position DP, the lock 71 is arranged to contact the front end of the lock 22 to prevent a backward movement of the detector 60 and the front end of the upper plate 61 is arranged to contact the rear end of the stopper wall 26 to prevent a forward movement of the detector 60. As a result, the detector 60 is held at the detection position DP. The arm main body 17 cannot be confirmed visually through the confirmation window 65, as shown in FIG. 2, when the detector 60 is at the standby position SP, but can be confirmed visually through the confirmation window 65, as shown in FIG. 4, when the detector 60 is at the detection position DP. Thus, the position of the detector 60 can be confirmed through the confirmation window 65.

Figure 5:
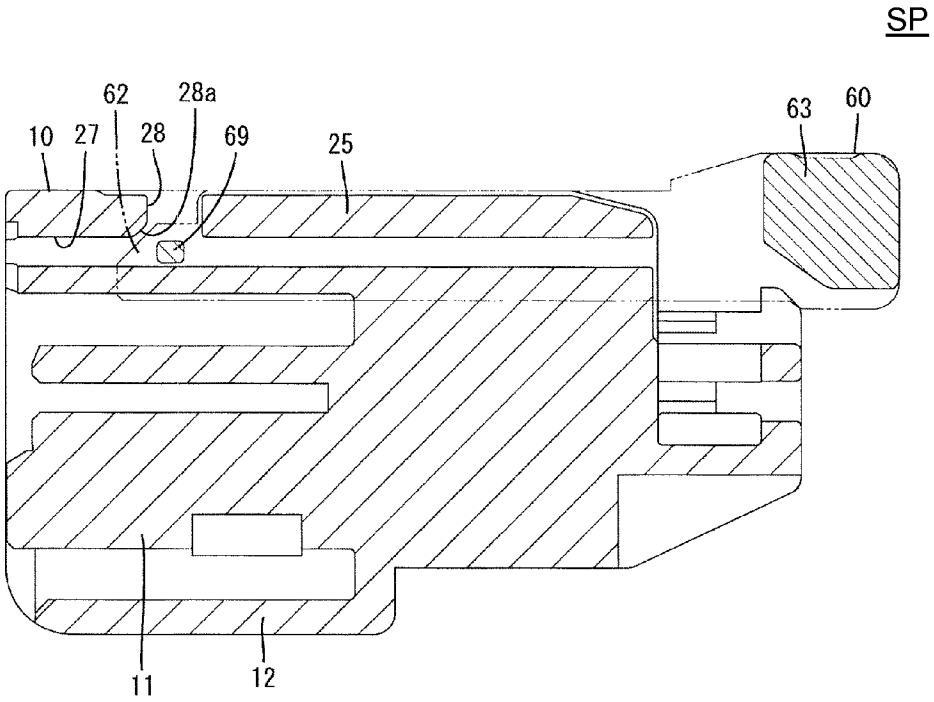
FIG. 5 is a section, cut at a position corresponding to restricting portions, showing a state where the detector is held at the standby position in the housing.

In assembling the detector 60 with the lock arm 15, the resilient locking portion 64 is inserted into the inserting tube 18 from behind, the rails 23 are inserted into the rail receiving grooves 67 and the restricting portions 69 are inserted into the guides 27. In that state, the detector 60 is slid forward to the standby position SP (see FIGS. 1 to 3). At the standby position SP, the restricting portions 69 are arranged to face the both escaping portions 28 from below, as shown in FIG. 5.

The housing 10 then is connected to the mating housing 90 along the connecting direction CD. In the process of connecting the two housings 10, 90, the lock 93 of the mating housing 90 interferes with the lock 22 to deflect and deform the lock arm 15. Thus, the arm main body 17 is inclined and the detecting member 60 assembled with the arm main body 17 also is inclined. When the detector 60 is inclined, the restricting portions 69 are inserted into the escaping portions 28 from below to avoid interference of the restricting portions 69 and the side walls 25. Further, the stopper wall 26 of the housing 10 is located at a forward projecting position of the resilient locking portion 64 of the detector 60 in the inclined state.

Thereafter, when the two housings 10, 90 reach a proper connection position as shown in FIG. 3, the lock 22 moves over the lock 93, the lock arm 15 is resiliently displaced in the return direction and the lock 22 engages the rear end of the lock projection 93. In this way, the two housings 10, 90 are held in a connected state. When the two housings 10, 90 reach the proper connection position, each terminal fitting 50 is connected electrically to the corresponding mating terminal fitting 80 (see FIG. 4).

Further, when the two housings 10, 90 reach the proper connection position as shown in FIG. 3, the lock projection 93 is fit into the lock hole 21 to push up the locking projection 71, thereby releasing a locked state of the locking projection 71 and the lock 22. In this way, a movement of the detector 60 to the detection position DP is allowed.

Subsequently, the detector 60 is pushed toward the detection position DP. In the process of moving the detector 60 toward the detection position DP, the locking projection 71 slides on the upper surfaces of the lock projection 93 and the lock 22. Thus, the resilient locking portion 64 is kept deflected. At this time, the upper plate 61 of the detector 60 also is pushed up by the resilient locking portion 64 to be resiliently deflected and deformed (see FIG. 3). If the detector 60 is kept entirely inclined except at the resilient locking portion 64 when moving toward the detection position DP, the restricting portions 69 contact the front walls of the escaping portions 28 and prevent the detector 60 from being pushed to the detection position DP while being kept in the inclined state. Further, if it is attempted to push the detector 60 kept in the entirely inclined state to the detection position DP, the front ends of the restricting portions 69 slide on guiding inclined surfaces 28*a* formed on the lower ends of the front walls of the escaping portions 28 to be guided down. Thus, the inclined state of the detector 60 is canceled gradually. In this way, the detector 60 is returned to a horizontal posture extending along the front-back direction (connecting direction CD). As the detector 60 returns substantially to the horizontal posture, the restricting portions 69 are inserted into the guides 27. The restricting portions 69 then slide on the guides 27 and move forward to guide the detector 60 to the detection position DP.

When the detector 60 reaches the detection position DP, as shown in FIG. 4, the locking projection 71 moves over the upper surface of the lock 22 and the resilient locking portion 64 is displaced resiliently in the return direction. In this way, the locking projection 71 is arranged to lock to the front end of the lock 22 and a movement of the detector 60 toward the standby position SB in the return direction is prevented.

On the other hand, if the two housings 10, 90 are in a semi-connected state, the lock 71 is not pushed up by the lock projection 93 and the locked state of the locking projection 71 and the lock 22 is maintained. Thus, the detector 60 cannot be moved from the standby position SP to the detection position DP. Therefore, if the detector 60 is immovable, it can be judged that the two housings 10, 90 are in the semi-connected state.

As described above, the restricting portions 69 come into contact with the front walls of the escaping portions 28 if the detector 60 is in the inclined state when being pushed to the detection position DP. This prevents the detector 60 from reaching the detection position DP while being kept in the inclined state. Further, the detector 60 can reach the detection position DP in a state corrected to the horizontal posture by being guided by the guiding inclined surfaces 28*a* of the escaping portions 28. Thus, the front end of the detector 60 interferes with the stopper wall 26 located at an intermediate position of a virtual movement path of the detector 60 when the detector 60 in the inclined state is pushed directly forward, and the detector 60 does not reach the detection position DP, thereby avoiding a situation where the detector 60 is not held at the detection position DP and comes out of the housing 10 and other unfavorable situations.

Further, in the process of moving the detector 60 to the detection position DP, the restricting portions 69 are inserted into the guides 27, thereby ensuring stability in movement when the detector 60 reaches the detection position DP from the standby position SP.

The invention is not limited to the above described and illustrated embodiment. For example, the following modes are also included in the technical scope of the present invention.

The front ends of the escaping portions may arcuately extend toward front end sides of the guide portions.

The guides that function to guide the movement of the detector can be omitted.

The locking projection of the resilient locking portion may be arranged to be lockable to a recess of the mating housing, thereby preventing a return movement of the detector to the standby position.

The numbers of the restricting portions and the escaping portions are arbitrary. For example, one restricting portion and one escaping portion may be respectively provided on the detector and the housing.

REFERENCE SIGNS

10 . . . housing
15 . . . lock arm
26 . . . stopper wall (wall)
27 . . . guide portion
28 . . . escaping portion
28*a* . . . guiding inclined surface
60 . . . detecting member
69 . . . restricting portion
90 . . . mating housing

What is claimed is:

1. A connector, comprising:

a housing configured for connection to a mating housing along a connecting direction and including at least one deflectable lock arm, side walls extending in the connecting direction at opposite respective sides of the lock arm, guide grooves formed in opposed facing surfaces of the side walls and extending in the connecting direction, and an escaping recess formed in each side wall and extending up from the respective guide groove in a direction intersecting the connecting direction; and at least one detector movable substantially in a connecting direction from a standby position to a detection position in a state supported on the lock arm, restricting portions projecting from opposite sides of the detector and slidably engaged in the guide grooves of the side walls, the restricting portions being configured to fit respectively in the escaping recesses, wherein:

the lock arm is deflected and deformed and the detector is kept at the standby position in a state inclined with respect to the connecting direction in the process of connecting the housing to the mating housing;

the lock arm is displaced in a return direction to hold the mating housing in a connected state and the detector is allowed to move to the detection position as the housing is connected properly to the mating housing; and the restricting portions are inserted respectively in the escaping recesses when the detector is inclined in a connecting process and configured to prevent the detector from reaching the detection position while being kept in an inclined state by causing the restricting portions to contact a wall surface substantially facing in a moving direction of the detector when the detector moves from the standby position to the detection position.

2. The connector of claim 1, wherein the slidable engagement of the guides and the restricting portions guide a movement of the detector in the process of moving the detector from the standby position to the detection position.

3. The connector of claim 2, wherein opening edges of the guides and/or of the escaping portions are curved and/or chamfered.

4. The connector of claim 1, wherein the walls of the housing are present at an intermediate position of a virtual movement path when the detector in the inclined state in the connecting process is assumed to move to the detection position while being kept in the inclined state.

5. The connector of claim 1, wherein the detector includes an upper plate, two side plates extending substantially in the connecting direction along the upper plate, a rear portion extending in the width direction and a resilient locking portion substantially extending forward from the rear portion.

6. The connector of claim 1, wherein a front end of each of the restricting portions is inclined back toward a projecting tip and a rear end of each of the restricting portion is arranged along the width direction.

7. The connector of claim 1, wherein, when the detector is at the standby position, a retaining receiving portion thereof is arranged to contact a retaining portion of the housing to prevent a backward movement of the detector and a locking projection of the detector is arranged to contact a rear end of a lock of the housing to prevent a forward movement of the detector.

8. A connector of claim 7, wherein, when the detector is at the detection position, the locking projection is arranged to contact the lock to prevent a backward movement of the detector and the upper plate is arranged to contact a stopper wall of the housing to prevent a forward movement of the detector.

9. The connector of claim 1, wherein at least one confirmation window is provided in the detector and/or the housing so as to allow confirming the position of the detector through the confirmation window.

10. A connector, comprising:

a housing configured for connection to a mating housing and including at least one deflectable lock arm; and at least one detector movable substantially in a connecting direction from a standby position to a detection position in a state supported on the lock arm, wherein:

the lock arm is deflected and deformed and the detector is kept at the standby position in a state inclined with respect to the connecting direction in the process of connecting the housing to the mating housing;

the lock arm is displaced in a return direction to hold the mating housing in a connected state and the detector is allowed to move to the detection position as the housing is connected properly to the mating housing;

the detector includes at least one restricting portion; and the housing includes at least one escaping portion extending in a direction intersecting the connecting direction, configured so that the restricting portion is inserted therein when the detector is inclined in a connecting process and configured to prevent the detector from reaching the detection position while being kept in an inclined state by causing the restricting portion to contact a wall surface substantially facing in a moving direction of the detector when the detector moves from the standby position to the detection position, the escaping portion has at least one guiding inclined surface configured to cancel the inclined state of the detector and guide the detector to be in a proper posture by causing the detector moving toward the detection position to slide thereon, on the wall surface substantially facing in the moving direction of the detector to the detection position.

11. A connector, comprising:

a housing configured for connection to a mating housing and including at least one deflectable lock arm; and at least one detector movable substantially in a connecting direction from a standby position to a detection position in a state supported on the lock arm, the detector includes an upper plate, two side plates extending substantially in the connecting direction along the upper plate, a rear portion substantially extending in the width direction, at least one restricting portion and a resilient locking portion substantially extending forward from the rear portion, a front end of the upper plate being retracted more backward with respect to the front ends of the side plates and the front end of the resilient locking portion, wherein:

the lock arm is deflected and deformed and the detector is kept at the standby position in a state inclined with respect to the connecting direction in the process of connecting the housing to the mating housing;

the lock arm is displaced in a return direction to hold the mating housing in a connected state and the detector is allowed to move to the detection position as the housing is connected properly to the mating housing; and the housing includes at least one escaping portion extending in a direction intersecting the connecting direction, configured so that the restricting portion is inserted therein when the detector is inclined in a connecting process and configured to prevent the detector from reaching the detection position while being kept in an inclined state by causing the restricting portion to contact a wall surface substantially facing in a moving direction of the detector when the detector moves from the standby position to the detection position.

* * * * *